US010961692B2

(12) United States Patent
Varma et al.

(10) Patent No.: US 10,961,692 B2
(45) Date of Patent: Mar. 30, 2021

(54) TUB SPOUT DIVERTER SEAL MEMBER

(71) Applicant: Kohler Co., Kohler, WI (US)

(72) Inventors: Shashank Varma, Sheboygan, WI (US); Matthew J. Ball, Sheboygan, WI (US); Andrew D. Wieberdink, Cedar Grove, WI (US); Evan Yee, Grafton, WI (US); Kellen D. Beauchesne, Spring Green, WI (US)

(73) Assignee: KOHLER CO., Kohler, WI (US)

( * ) Notice: Subject to any disclaimer, the term of this patent is extended or adjusted under 35 U.S.C. 154(b) by 151 days.

(21) Appl. No.: 16/101,873

(22) Filed: Aug. 13, 2018

(65) Prior Publication Data

US 2020/0048880 A1 Feb. 13, 2020

(51) Int. Cl.
*E03C 1/04* (2006.01)
*E03C 1/042* (2006.01)

(52) U.S. Cl.
CPC ..... *E03C 1/0404* (2013.01); *E03C 1/042* (2013.01); *E03C 1/0408* (2013.01); *E03C 2201/30* (2013.01)

(58) Field of Classification Search
CPC ..... E03C 1/0404
USPC ..... 4/678
See application file for complete search history.

(56) References Cited

U.S. PATENT DOCUMENTS 8,857,471 B2 * 10/2014 Huang ..... F16K 3/0227 137/801

OTHER PUBLICATIONS

Photograph of Lota Seal, available prior to Aug. 24, 2015 (further information not available); 1 pg.

* cited by examiner

*Primary Examiner* — Christine J Skubinna
(74) *Attorney, Agent, or Firm* — Foley & Lardner LLP

(57) ABSTRACT

A diverter seal member for a diverter structure of a tub spout structure includes a central body, a first seal extension, and a second seal extension. The central body includes a first side, a second side, and an aperture extending completely through the central body between the first side and the second side of the central body. The first seal extension extends from the first side of the central body and around a central axis that extends axially through a center of the aperture. The first seal extension includes a first extension side, a second extension side, and an extension end. The extension end of the first seal extension extends substantially perpendicularly to the first extension side and the second extension side of the first seal extension. The second seal extension extends from the second side of the central body around the central axis of the aperture.

20 Claims, 12 Drawing Sheets

TUB SPOUT DIVERTER SEAL MEMBER

BACKGROUND

The present application relates to a tub spout diverter seal member for sealing a diverted tub spout structure. Typically, tub spout structures leak while the water is being diverted away from the tub spout structure (e.g., to a showerhead). These leaks are either due to manufacturing variations that are inherently formed in the tub spout during the casting process or due to wear from prolonged use of the tub spout structure over time, as various deposits (such as calcium) build up within the tub spout structure.

Furthermore, conventional tub spout seal members are not sensitive enough to prevent leaks from occurring, in particular, when operating under low water pressure (i.e., 10 pounds per square inch (psi) and lower, where normal water pressure through tub spouts is around approximately 40-45 psi). For example, conventional tub spout seal members may have leaks of up to 0.01 gallons per minute at 10 psi. Additionally, conventional tub spout seals may not prevent leaks with multiple different configurations of tub spouts in order to provide a universal tub spout seal.

Other conventional tub spout seals require the use of springs in order to automatically move the tub spout structure to an open position when the water is turned off. However, these conventional tub spout structures require multiple expensive components, such as machined brass housings, springs, and molded caps with o-rings and a piston, and therefore are expensive.

The above-described leaks cause various amounts of water (depending on the leak size) to be wasted down the drain. Accordingly, it would be advantageous to provide a tub spout structure that does not leak at all, even under low water pressure, in order to conserve water by reducing or eliminating water waste and to comply with any leak-rate requirements from regulatory agencies. These and other advantages of the system described herein will become apparent to those reviewing the present disclosure.

SUMMARY

At least one embodiment relates to a diverter seal member for a diverter structure of a tub spout structure that includes a central body, a first seal extension, and a second seal extension. The central body includes a first side, a second side, and an aperture extending completely through the central body between the first side and the second side of the central body. The first seal extension extends from the first side of the central body and around a central axis that extends axially through a center of the aperture. The first seal extension includes a first extension side, a second extension side, and an extension end. The extension end of the first seal extension extends substantially perpendicularly to the first extension side and the second extension side of the first seal extension. The second seal extension extends from the second side of the central body around the central axis of the aperture.

At least one embodiment relates to a diverter structure for a tub spout structure that includes a diverter gate and a diverter seal member. The diverter gate includes a seal housing. The seal housing includes a back wall and a circumferential side wall that extends substantially perpendicularly to the back wall. The diverter seal member is configured to be positioned within a cup defined by the back wall and the side wall of the seal housing of the diverter gate. The diverter seal member includes a central body, a first seal extension, and a second seal extension. The central body includes a first side, a second side, and an aperture extending completely through the central body between the first side and the second side of the central body. The first seal extension extends from the first side of the central body and around a central axis that extends axially through a center of the aperture. The first seal extension includes a first extension side, a second extension side, and an extension end. The extension end of the first seal extension extends substantially perpendicularly to the first extension side and the second extension side of the first seal extension. The second seal extension extends from the second side of the central body around the central axis of the aperture.

At least one embodiment relates to a tub spout structure that includes a tub spout body, a diverter structure, and a diverter seal member. The tub spout body has an inlet configured to receive water, an outlet, and a through-hole fluidly connecting the inlet and the outlet. The diverter structure comprises a diverter gate. The diverter gate includes a seal housing that includes a back wall and a circumferential side wall that extends substantially perpendicularly to the back wall. The diverter seal member is configured to be positioned within a cup defined by the back wall and the side wall of the seal housing of the diverter gate. The diverter seal member comprises a central body, a first seal extension, and a second seal extension. The central body includes a first side, a second side, and an aperture extending completely through the central body between the first side and the second side of the central body. The first seal extension extends from the first side of the central body and around a central axis that extends axially through a center of the aperture. The first seal extension includes a first extension side, a second extension side, and an extension end. The extension end of the first seal extension extends substantially perpendicularly to the first extension side and the second extension side of the first seal extension. The second seal extension extends from the second side of the central body around the central axis of the aperture. The seal housing is moveable relative to the tub spout body such that the seal housing and the diverter seal member block a flow of the water to the outlet in a closed position.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The accompanying drawings, which are included to provide further understanding of the concepts discussed herein, are incorporated in and constitute a part of this specification, and illustrate embodiments of the present disclosure and together with the detailed description serve to explain the principles of the present disclosure.

DETAILED DESCRIPTION

Before turning to the figures, which illustrate the various exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to the figures, disclosed herein are tub spout diverter seal members, as shown according to various exemplary embodiments. Due to the shape and relative size and dimensions, the seal members described herein prevent leaks within a diverted tub spout structure, creating a zero-leak tub spout structure.

Tub Spout Structure

Figure 1:
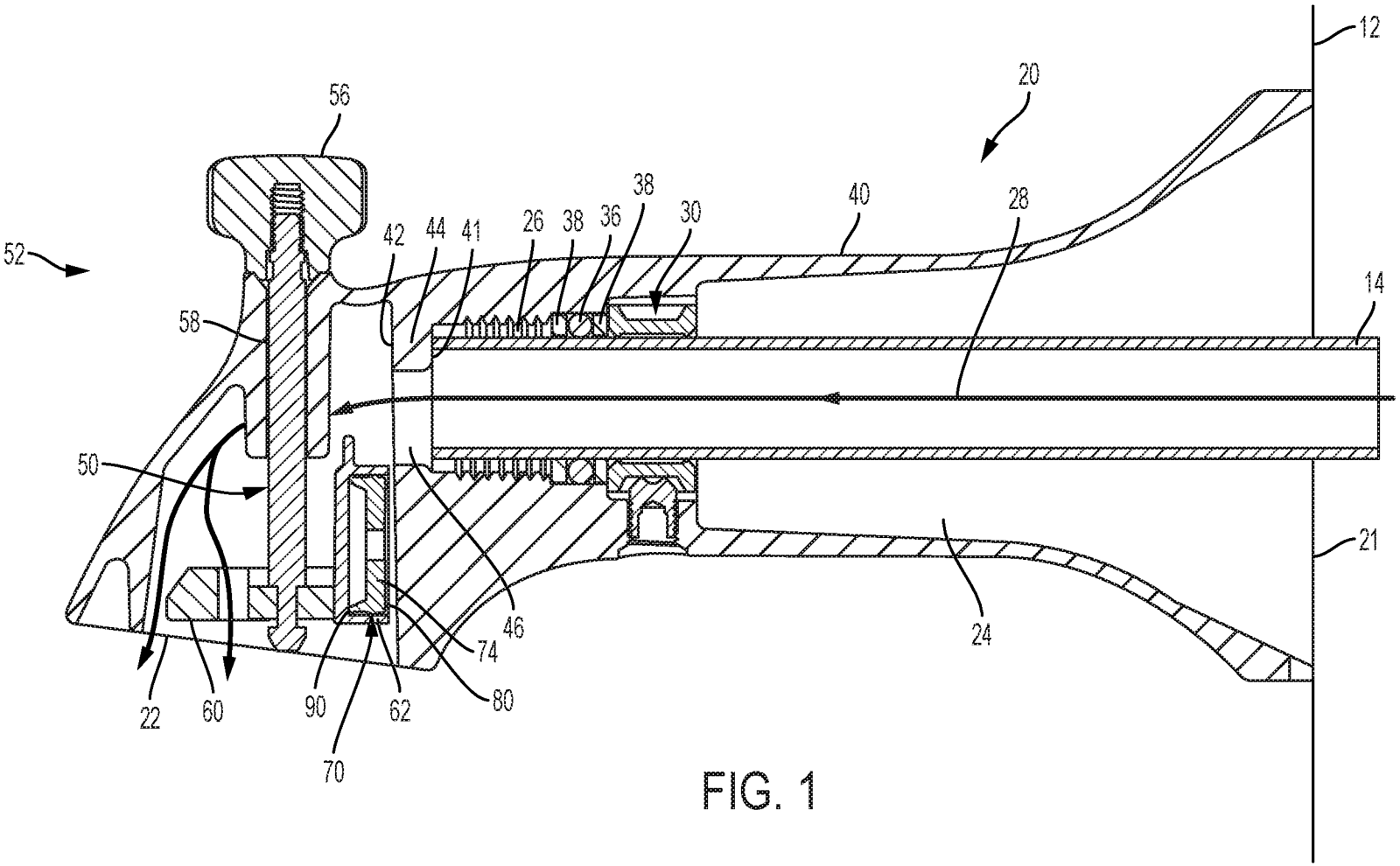
FIG. 1 is a cross-sectional view of a tub spout structure attached to a water pipe and with the diverter structure in an open position, according to an embodiment of this application.

FIG. 1 shows a tub spout structure 20 that controls water flow from a water tube or pipe 14 that extends out from a wall 12 (e.g., a wall of a shower area or enclosure) and into or over, for example, a bathtub (not shown). The tub spout structure 20 includes a tub spout outer shell or body 40 that defines and extends between a first end 21 and a second end 22. The first end 21 of the tub spout body 40 is configured to attach to the wall 12 and the second end 22 of the tub spout body 40 extends out away from the wall 12. The first end 21 defines an inlet of the tub spout body 40 that is configured to receive water into the tub spout body 40, and the second end 22 defines an outlet of the tub spout body 40 that is configured to release water from within the tub spout body 40.

The tub spout structure 20 includes a through-hole 24 (e.g., an internal bore or cavity) that extends completely through the entire tub spout body 40 and defines an inner area of the tub spout body 40. The through-hole 24 fluidly connects the inlet and the outlet of the tub spout body 40. The through-hole 24 allows water to be moved completely through an inner area of the tub spout structure 20. The through-hole 24 extends from the inlet at the first end 21 to the outlet at the second end 22 of the tub spout structure 20. At the first end 21, the through-hole 24 is an inlet hole through which the tube spout body 40 is configured to receive the water pipe 14 (and therefore receive water). At the second end 22, the through-hole 24 is the outlet hole through which water flows from the tub spout body 40.

Accordingly, as shown in FIG. 1, the first end 21 is configured to receive the water pipe 14 within the through-hole 24 at the first end 21 such that the water pipe 14 extends into a portion of the inner area of the tub spout structure 20 with a portion of the tub spout body 40 extending around the portion of the water pipe 14 that extends beyond the wall 12. An end of the water pipe 14 is positioned within the inner area of the tub spout structure 20 (e.g., within a middle portion of the through-hole 24). Accordingly, water can flow from a structure (e.g., fluid conduit, piping, etc.) within the wall 12, through the water pipe 14, into the through-hole 24 of the tub spout structure 20, and optionally out from the second end 22 of the tub spout structure 20 (as described further herein). If the diverter structure 50 of the tub spout structure 20 is in the open position 52 (as described further herein), the second end 22 is configured to allow the water to flow or exit out from the tub spout structure 20 into another area, such as a bathtub.

The end of the water pipe 14 is positioned next to and just before (relative to the direction of flow through the water pipe 14) an inner wall 44 of the tub spout body 40 (that is positioned between the first end 21 and the second end 22 and within or defines part of the through-hole 24). The inner wall 44 includes or defines a wall through-hole or aperture (referred to herein as the aperture 46) that is part of the through-hole 24, such that the through-hole 24 extends completely through the inner wall 44. The inner wall 44 has a first wall surface or side (referred to herein as the first side 41) and a second wall surface or side (referred to herein as the second side 42) on opposite ends of the inner wall 44. The first side 41 is closer to the first end 21 of the tub spout body 40 and the second side 42 is closer to the second end 22 of the tub spout body 40. The end of the water pipe 14 is positioned proximate to or abutting the first side 41 of the inner wall 44.

To attach to the water pipe 14 (as shown in FIG. 1), the tub spout structure 20 includes a clamping structure 30 (as shown best in FIGS. 2-3) that is configured to surround (e.g., encircle) and clamp to the outside surface of the water pipe 14. As shown in FIG. 3, the clamping structure 30 includes at least one clamp 32 and a set screw 34 that extends through a threaded hole 35 in the lower wall of the tub spout body 40. For example, the clamping structure 30 can include two (or more) clamps 32 (e.g., an upper clamp and a lower clamp) that together extend around the outer surface of the water pipe 14. To attach the tub spout structure 20 and the water pipe 14, the water pipe 14 is cut to the desired length and inserted into the through-hole 24 through the first end 21 of the tub spout body 40. Once the water pipe 14 has been positioned within the inner area of the tub spout structure 20, the set screw 34 is screwed into the threaded-hole 35 in the lower wall of the tub spout body 40 to tighten the one or more clamps 32 around the outside of the water pipe 14, thus securing the entire tub spout structure 20 to the water pipe 14. The set screw 34 may be, for example only, a ¼-28 stainless steel set screw.

Alternatively, the tub spout structure 20 may be screwed onto the water pipe 14 with a threaded connection (and thus does not include the clamping structure 30). Accordingly, the tub spout structure 20 may include internal threads 26, such as along a middle portion of the length of the through-hole 24, that complement external threads on or near the end portion of the water pipe 14. For example only, the tub spout structure 20 may have a ½ NPT (national pipe thread) connection to the water pipe 14. The tub spout structure 20 may be adaptable to attach to the water pipe 14 via the clamping structure 30 or the threads 26, depending on, for example, the configuration of the water pipe 14. Accordingly, the tub spout structure 20 in FIGS. 1-3 includes both the clamping structure 30 and the threads 26. However, the tub spout structure 20 may only include and use one of the clamping structure 30 or the threads 26, if desired.

To seal to the outer surface of the water pipe 14, the illustrated tub spout structure 20 includes an o-ring seal member 36 surrounded on both sides by washers 38. The o-ring seal member 36 is positioned within a bore in the body 40 and extends around the outer perimeter of the water pipe 14 to seal between the inner surface defining the bore in the body 40 and the outer perimeter of the water pipe 14. One or more washers 38 are positioned on one or more sides of the o-ring seal member 36 (along the length of the through-hole 24) and also extend around the outer perimeter of the water pipe 14. The washers 38 help the o-ring seal member 36 seal to the outside surface of the water pipe 14. The washers 38 may be constructed out of a variety of different materials including plastic.

Certain components of the tub spout structure 20 (in particular the tub spout body 40) may be constructed out of a variety of different materials, including but not limited to zinc or brass. The water pipe 14 may be constructed out of a variety of different materials, including but not limited copper. Although water is referred to herein, it is understood that the tub spout structure 20 can be used with a variety of different liquids.

Diverter Structure

To control the flow of water from the water pipe 14, the tub spout structure 20 includes a diverter structure 50, the entirety of which is movable relative to the tub spout body 40 between an open position 52 and a diverted or closed position 54.

Figure 2:
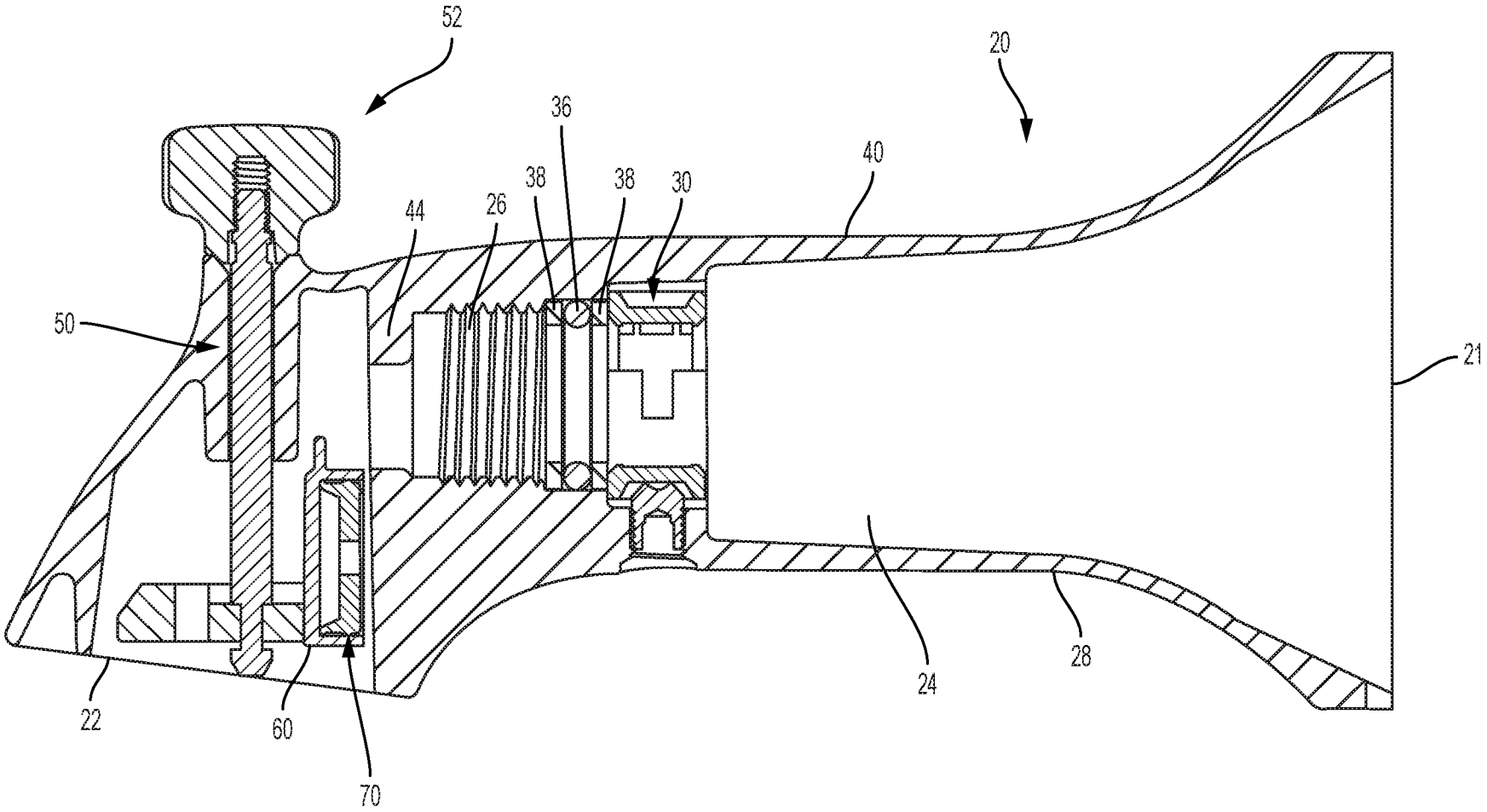
FIG. 2 is a cross-sectional view of the tub spout structure of FIG. 1 without the water pipe.
Figure 3:
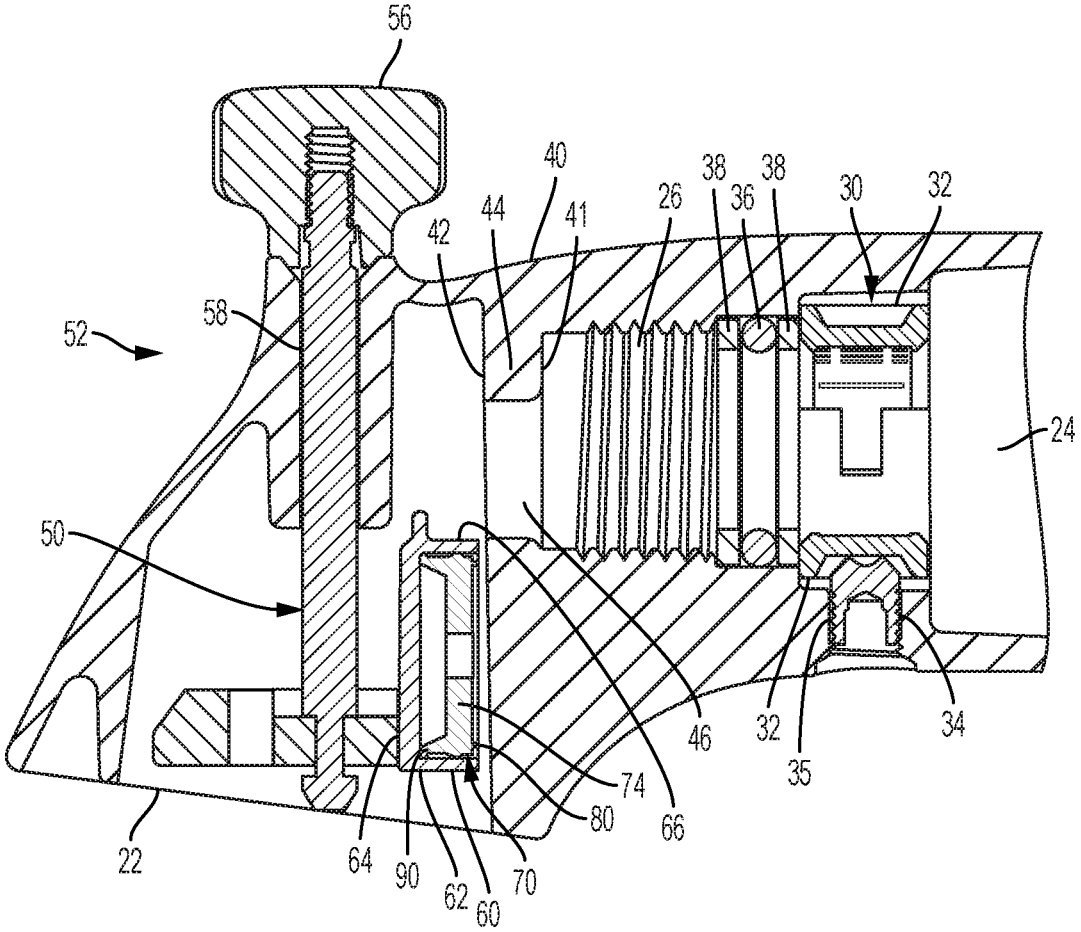
FIG. 3 is an enlarged view of a portion of the tub spout structure of FIG. 2.

In the open position 52 (as shown in FIGS. 1-3), the diverter structure 50 allows water from the water pipe 14 to flow completely through the tub spout structure 20 and to be directed into another area, such as a bathtub. In particular, the water flows out from the end of the water pipe 14, into and through the middle area of the through-hole 24 (i.e., the inner area of the tub spout body 40), through the aperture 46 in the inner wall 44, over, around, and/or through the diverter gate 60, out through the second end 22 of the tub spout structure 20, and into, for example, the bathtub, as shown by flow line 28 in FIG. 1.

Figure 4:
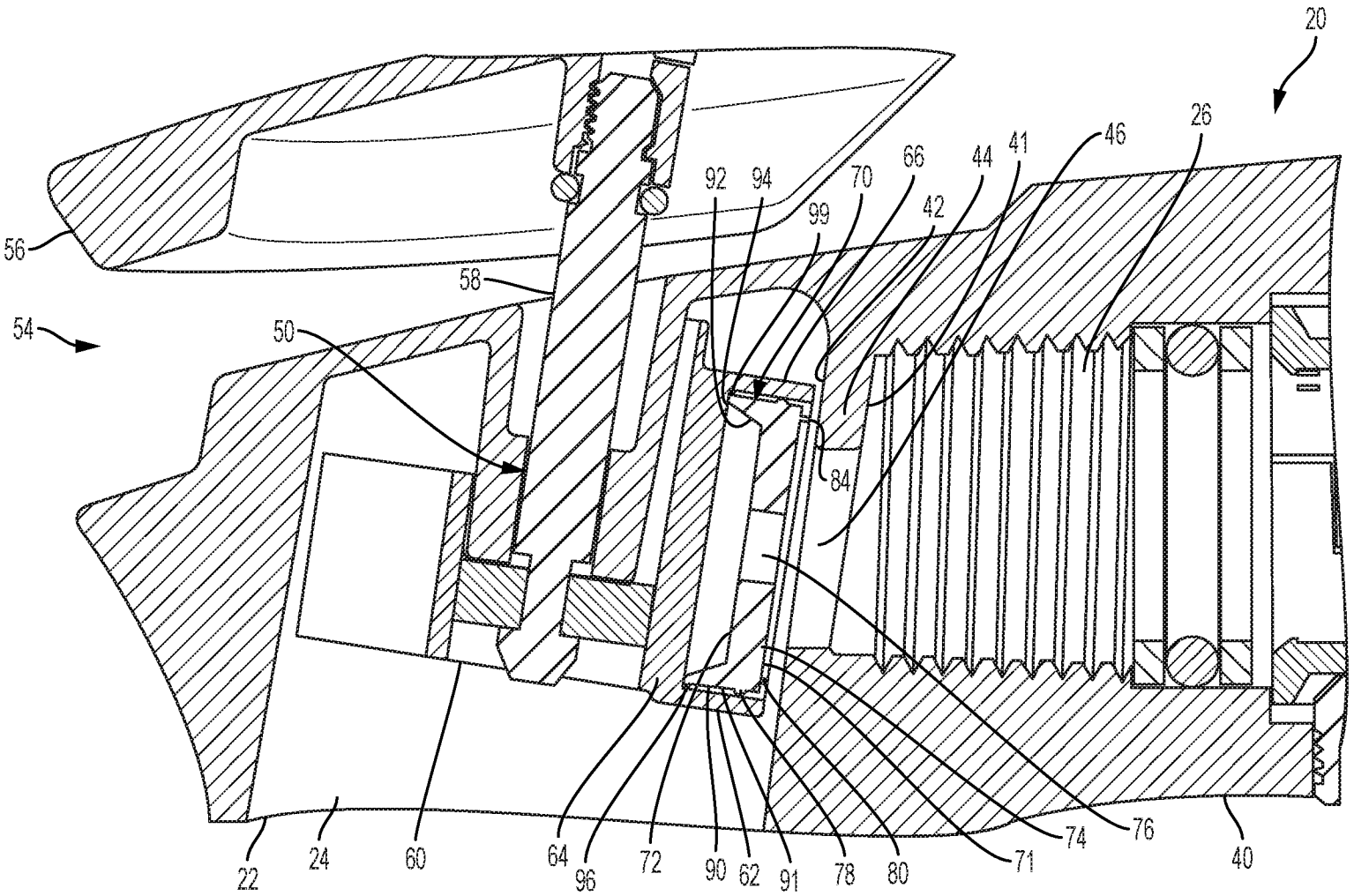
FIG. 4 is an enlarged view of a portion of a tub spout structure according to another embodiment with the diverter structure in a closed position.

In the closed position 54 (as shown in FIG. 4), the diverter structure 50 blocks the flow of water to the outlet in the second end 22 of the tub spout structure 20, such as to redirect the water to another device, such as a showerhead and/or handshower). For example, the diverter structure 50 in the closed position stops the flow of water through the tub spout body 40, increases the pressure within the water pipe 14, and causes the water to be diverted to another pipe, such as a pipe leading to a showerhead.

The diverter structure 50 includes a knob or handle 56, a lift rod 58, and a lift or diverter gate 60, which are all operably coupled together to move by a common distance. Accordingly, moving (e.g., lifting) the handle 56 relative to the tub spout body 40 in turn moves the diverter gate 60 a corresponding distance, such as to block the flow of water to the outlet in the closed position. Accordingly, the diverter structure 50 may be moved up and down vertically relative to the tub spout body 40. The diverter structure 50 may also include the seal member 70 (as described further herein), or the seal member 70 may be a separate component from the diverter structure 50. Regardless, since the seal member 70 is positioned within the diverter gate 60 (as described further herein), the seal member 70 is moved with the diverter structure 50.

The handle 56 is positioned outside of the tub spout body 40 (e.g., on top of the tub spout body 40) to be accessible to a user. The lift rod 58 extends between and connects the handle 56 and the diverter gate 60. The diverter gate 60 is positioned within the inner area of the tub spout body 40 (along the through-hole 24) and between the first end 21 and the second end 22 (in particular between the end of the water pipe 14 and the second end 22). The diverter gate 60 can slide or move within the through-hole 24 of the tub spout body 40. The diverter gate 60 also includes apertures and/or notches that allow water to flow through and/or around the diverter gate 60 when the diverter gate 60 is in the open position 52.

As shown in FIG. 4, the diverter gate 60 includes a groove, cup, or seal housing 62 that is configured to receive and secure the seal member 70 (as described further herein). The seal housing 62 includes a back wall 64 and a circumferential or annular side wall 66 that extends substantially perpendicularly to the back wall 64 (e.g., in a circle). When assembled with the seal member 70, the side wall 66 extends completely annularly around the central axis 77 of the aperture 76 of the seal member 70 (as described further herein). The side wall 66 extends between a first end and a second end. The first end of the side wall 66 is open (in order to receive the seal member 70), and the second end of the side wall 66 is closed off by the back wall 64. The seal member 70 is positioned within a cavity or cup defined by the back wall 64 and the side wall 66 of the seal housing 62 such that the side wall 66 extends around the entire seal member 70 and the back wall 64 extends along one entire side of the seal member 70.

To move the diverter structure 50 from the open position 52 (as shown in FIG. 3) to the closed position 54 (as shown in FIG. 4), the user may lift up the handle 56, which lifts up the lift rod 58 and thus lifts up the diverter gate 60. This movement moves the seal housing 62 of the diverter gate 60 (and thus also the seal member 70 that is positioned within the seal housing 62) to a position in which the seal member 70 and the seal housing 62 block the flow of water to the outlet in the second end 22 from the water pipe 14 from flowing further through the through-hole 24 of the tub spout body 40, as described further herein.

Certain components of the diverter structure 50 may be constructed out of a variety of different materials. For example, the lift rod 58 may be constructed out of metal and the diverter structure 50 may be constructed out of plastic.

Diverter Seal Member

The tub spout structure 20 includes a diverter seal member 70 for the diverter structure 50. As shown in FIG. 4, the seal member 70 is configured to be positioned within the cup defined by the back wall 64 and the side wall 66 of the seal housing 62 and is movable within the seal housing 62 relative to the tub spout body 40. Accordingly, the seal member 70 is configured to seal with or against the second side 42 of the inner wall 44 of the tub spout body 40 when the diverter structure 50 is in the closed position 54 in order to, with the seal housing 62, block the flow of water from moving to the outlet of the tub spout body 40 and prevent any leaks from the tub spout structure 20. Accordingly, the diverter seal member 70 allows the tub spout structure 20 to have zero leaks when the diverter structure 50 is in the closed position 54.

Compared to conventional diverter seal members, since the seal member 70 completely prevents leaks (such that the diverter structure 50 is a "zero-leak" diverter), the seal member 70 saves a significant amount of water by preventing leaks from the tub spout structure 20. For example, conventional diverter structures can leak approximately 0.29 gallons per minute (gpm), which results in approximately 2.3 gallons of water wasted per shower, approximately 1,543 gallons of water wasted per household annually, and approximately 309 million gallons of water wasted annually across 200,000 homes. Other conventional diverter structures can leak approximately 0.1 to 0.2 gpm, which results in approximately 0.8 to 1.6 gallons of water wasted per shower, approximately 528 to 1,056 gallons of water wasted per household annually, and approximately 106 million to 211 million gallons of water wasted annually across 200,000 homes. Still other conventional diverter structures can leak approximately 0.01 to 0.05 gpm, which results in approximately 0.1 to 0.4 gallons of water wasted per shower, approximately 53 to 264 gallons of water wasted per household annually, and approximately 11 million to 53 million gallons of water wasted annually across 200,000 homes. Comparatively, the diverter structure 50 (with the seal member 70 or 170) does not leak or waste any water.

This water conservation is due to the particular configuration, shape, and size of the seal member 70 (or the seal member 170, as described further herein), such as the rectangular cross-section and relative dimensions of the first seal extension 80, the thinness of the second seal extension 90, and/or the rectangular cross-section and relative dimensions of the outer protrusion 96. Additionally, the relative position of the seal member 70, 170 to the second side 42 of the inner wall 44 of the tub spout body 40 (as described further herein) also allows for the seal member 70, 170 to provide a zero-leak configuration. Each of these aspects allow the seal member 70 (or the seal member 170) provide a completely and effective seal, in particular under low pressure.

Figure 5:
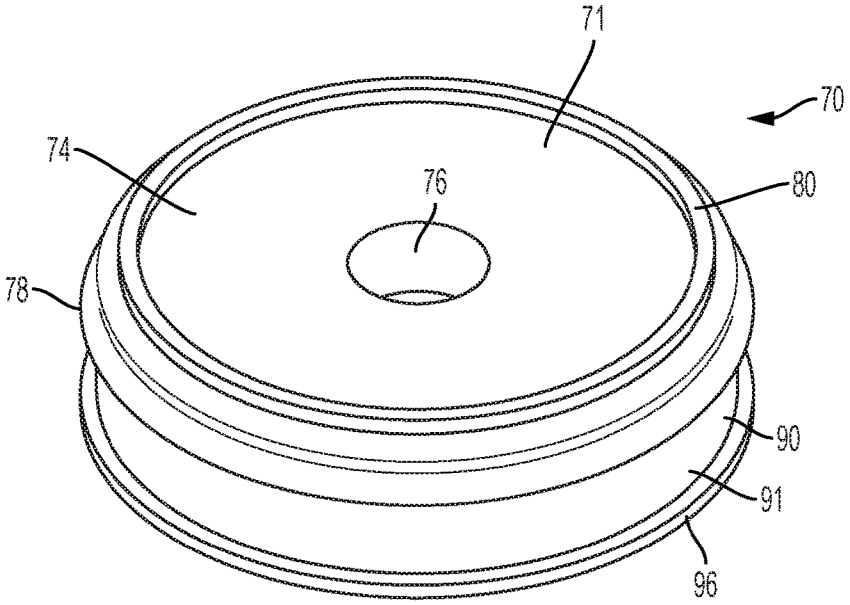
FIG. 5 is a perspective view of a seal member according to an embodiment.
Figure 6:
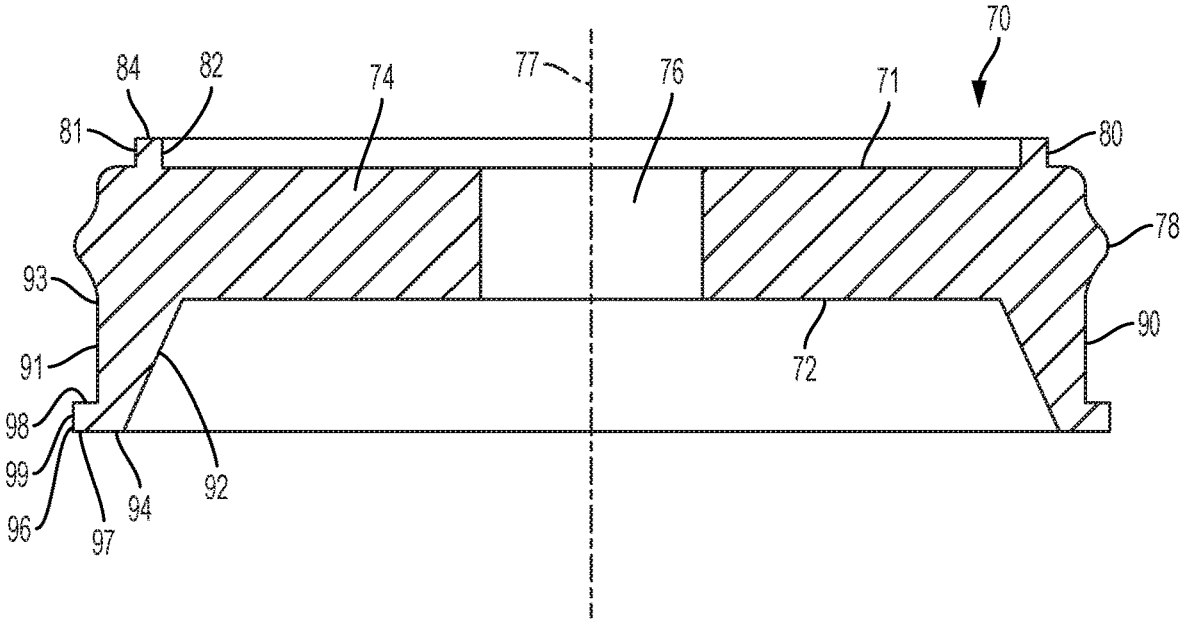
FIG. 6 is a cross-sectional view of the seal member of FIG. 5.

As shown in FIGS. 5 and 6, the seal member 70 includes a central body 74 and two seal features, which include a first seal extension 80 and a second seal extension 90. The seal member 70 is positioned such that the first seal extension 80 is upstream from the second seal extension 90 (as shown in FIG. 4). As shown in FIG. 6, the central body 74 is a substantially flat portion that includes a first surface or side 71 and a second surface or side 72. The central body 74 includes or defines a seal aperture (referred to herein as the aperture 76) extending along a center or central axis 77 (that extends axially through the center of the aperture 76) and completely through the central body 74, between the first side 71 and the second side 72 of the central body 74. Water can flow through the aperture 76 when the diverter structure 50 is in the closed position 54.

Also shown in FIG. 6, the central body 74 further includes a side bump or protrusion 78 that is configured to abut the inner sides of the side wall 66 of the seal housing 62 (as shown in FIG. 4). The side protrusion 78 is relatively rounded or curved (e.g., convex, arcuate, etc.), extends around the entire outer perimeter of the central body 74, and is positioned between the first side 71 and the second side 72 of the central body 74. The side protrusion 78 acts as a locator to maintain the proper position of the seal member 70 within the seal housing 62. For example, the side protrusion 78 prevents the seal member 70 from becoming angled within the seal housing 62 during use. Accordingly, the side protrusion 78 ensures that the first side 71 and the second side 72 of the seal member 70 are substantially parallel to the back wall 64 of the seal housing 62. The end 84 of the first seal extension 80 and the upstream surface of the back wall 64 of the seal housing 62 should be parallel (±5°) to each other.

The first seal extension 80 is a ring-shaped or annular face or flange seal member that extends from the first side 71 of the central body 74 of the seal member 70. The first seal extension 80 extends continuously and completely (in a circle, for example only) annularly around the central axis 77 of the aperture 76. The first seal extension 80 is radially spaced outward apart from the aperture 76. When the diverter structure 50 is positioned in the closed position 54 (and the seal member 70 is positioned within the seal housing 62), the first seal extension 80 faces or extends from the first side 71 of the central body 74 and is configured to seal with the second side 42 of the inner wall 44 of the tub spout body 40 (as shown in FIG. 4).

As shown in FIG. 6, the first seal extension 80 has an outer or first extension side (referred to herein at the first side 81), an inner or second extension side (referred to herein as the second side 82), and an extension end (referred to herein at the end 84). The first side 81 and the second side 82 are opposite each other and extend directly from the first side 71 of the central body 74. The end 84 extends between the first side 81 and the second side 82 and is the furthest away from the first side 71 of the central body 74 (i.e., the end of the first seal extension 80 that is opposite the first side 71). When assembled within the tub spout structure 20 and the diverter structure 50 is in the closed position 54, the end 84 of the first seal extension 80 directly faces and abuts the second side 42 of the inner wall 44 of the tub spout body 40 (as shown in FIG. 4) and the entire end 84 is configured to contact the second side 42 of the inner wall 44 of the tub spout body 40.

To provide a leak-proof seal with the inner wall 44 of the tub spout body 40, the first seal extension 80 has a substantially rectangular cross-section, as shown in FIG. 6. In particular, the end 84 of the first seal extension 80 extends substantially perpendicularly to the first side 81 and the second side 82 of the first seal extension 80. Both the first side 81 and the second side 82 of the first seal extension 80 extend substantially perpendicularly from and relative to the first side 71 of the central body 74 (and the end 84 of the first seal extension 80). The end 84 of the first seal extension 80 and the first side 71 of the central body 74 are substantially parallel to each other, and the first side 81 and the second side 82 of the first seal extension 80 are substantially parallel to each other. Each of these perpendicular and parallel measurements have a tolerance of ±1 to 2°.

Furthermore, the first seal extension 80 is relatively thin such that the length of the first side 81, the second side 82, and the end 84 are approximately equal to one another, thereby creating an approximately square cross-section of the first seal extension 80. The thin shape of the first seal extension 80 allows the first seal extension 80 to bend and flex the correct amount in order to create a complete seal. If the first seal extension were too thick, it would not be able to provide as complete of a seal. Accordingly, the optimal ratio of the width M3 to the length M4 (as described further herein and shown in FIG. 9) of the first seal extension 80 in order to achieve the correct amount of "thinness" of the first seal extension 80 is approximately 0.8±0.2 in.

The rectangular shape of the first seal extension 80 increases the sensitivity of the seal member 70 to lower fluid pressures (i.e., 10 psi and below). For example, the rectangular shape of the first seal extension 80 allows the first seal extension 80 to compress more easily, which allows the first seal extension 80 to provide a better seal at low pressures. Comparatively, conventional seal members that are rounded cannot compress as much (especially at low pressures), which decreases the effectiveness of conventional seal members, in particular at low pressures.

The second seal extension 90 is a ring-shaped or annular "flange cup" seal member or flange that is configured to flex radially outwardly under pressure when the diverter structure 50 is in the closed position 54 and water is flowing toward the seal member 70 (as described further herein) and that extends from the second side 72 of the central body 74 of the seal member 70. The second seal extension 90 extends at an angle (e.g., continuously and completely in a circle) relative to and annularly around the central axis 77 of the aperture 76. The second seal extension 90 is radially spaced outward apart from the aperture 76. When the diverter structure 50 is positioned in the closed position 54 (and the seal member 70 is positioned within the seal housing 62), the second seal extension 90 extends from the second side 72 of the central body 74 and is configured to seal with the back wall 64 and/or the inner side of the side wall 66 of the seal housing 62 (as shown in FIG. 4).

As shown in FIG. 6, the second seal extension 90 includes a first or outer surface or side 91, a second or inner surface or side 92, a base 93, and a tip or end 94. The outer side 91 and the inner side 92 are opposite each other and extend directly from the second side 72 of the central body 74. The inner side 92 is positioned radially inward from the outer side 91. The outer side 91 and the inner side 92 extend axially (and optionally at an oblique angle) between the base 93 and the end 94.

The base 93 and the end 94 of the second seal extension 90 are opposite each other along the axial length of the second seal extension 90. The base 93 closest to and positioned along the second side 72 of the central body 74, and the end 94 is the furthest away from the second side 72 of the central body 74 and positioned opposite to the base 93. The end 94 of the second seal extension 90 is configured to face and directly abut the back wall 64 of the seal housing 62 of the diverter gate 60, and the outer side 91 of the second seal extension 90 is configured to face the inner wall of the side wall 66 of the seal housing 62 (when the seal member 70 is positioned within the seal housing 62 of the diverter gate 60 of the diverter structure 50, as shown in FIG. 4).

As shown in FIG. 6, the second seal extension 90 has a tapered cross-section. Accordingly, the outer side 91 and the inner side 92 are angled relative to each other such that the base 93 and the end 94 are different lengths. In particular, the base 93 is longer than the end 94 such that the second seal extension 90 is thicker closer to the second side 72 of the central body 74 and thinner further away from the second side 72 of the central body 74. At least one of the outer side 91 and the inner side 92 of the second seal extension 90 may extend at an oblique angle relative to and from the second side 72 of the central body 74. According to one embodiment, the inner side 92 may extend at an oblique angle and the outer side 91 may extend at an orthogonal angle relative to and from the second side 72 of the central body 74. However, the outer side 91 and the inner side 92 of the second seal extension 90 may have the angles shown in FIGS. 5-9 or the angles shown with the outer side 191 and the inner side 192, respectively, of the second seal extension 190 in FIGS. 10-15 (as described further herein).

Also shown in FIG. 6, the second seal extension 90 includes an outer flange or protrusion 96 that is a seal member that extends along the entire outer perimeter of the second seal extension 90 (i.e., along the outer side 91) toward or at the end 94. The outer protrusion 96 protrudes radially outwardly from the outer side 91 of the second seal extension 90 between the base 93 and the end 94 of the second seal extension 90. Accordingly, the outer protrusion 96 is positioned along the length of the outer side 91, between the base 93 and the end 94.

The illustrated outer protrusion 96 has a first protrusion side (referred to herein at the first side 97), a second protrusion side (referred to herein at the first side 98), and a protrusion end (referred to herein at the end 99). The first side 97 and the second side 98 are opposite each other and extend directly from the outer side 91 of the second seal extension 90. The end 99 extends between the first side 97 and the second side 98 and is the furthest away from the outer side 91 of second seal extension 90 (i.e., the end of the outer protrusion 96 that is opposite the outer side 91). The end 99 of the outer protrusion 96 of the second seal extension 90 is configured to directly face, abut, and seal to the inner side of the side wall 66 of the seal housing 62 (when the seal member 70 is positioned within the seal housing 62, as shown in FIG. 4). The first side 97 (i.e., the side that is closest to the end 94) extends directly into and is aligned with the end 94 such that there is no vertical space between the first side 97 and the end 94.

To provide a leak-proof seal with the inner wall of the side wall 66 of the seal housing 62, the outer protrusion 96 has a substantially rectangular cross-section, as shown in FIG. 6. In particular, the end 99 of the outer protrusion 96 extends substantially perpendicularly to the first side 97 and the second side 98 of the outer protrusion 96. Both the first side 97 and the second side 98 of the outer protrusion 96 extend substantially perpendicularly from and relative to the outer side 91 of the second seal extension 90 (and the end 99 of the outer protrusion 96). The end 99 of the outer protrusion 96 and the outer side 91 of the second seal extension 90 are substantially parallel to each other, and the first side 97 and the second side 98 of the outer protrusion 96 are substantially parallel to each other. Each of these perpendicular and parallel measurements have a tolerance of ±1 to 2°.

Furthermore, the outer protrusion 96 is relatively thin such that the length of the first side 97, the second side 98 (that extends from the outer side 91), and the end 99 are approximately equal to one another, thereby creating an approximately square cross-section of the outer protrusion 96 (extending from the outer side 91 of the second seal extension 90). The thin shape of the outer protrusion 96 allows the outer protrusion 96 to bend and flex the correct amount in order to create a complete seal. If the outer protrusion were too thick, it would not be able to provide as complete of a seal. Accordingly, the optimal ratio of the width M10 to the length (i.e., the distance between the end 99 and the outer side 91) (as described further herein and shown in FIG. 9) of the outer protrusion 96 in order to achieve the correct amount of "thinness" of the outer protrusion 96 is approximately 0.8±0.2 in.

The shape of the outer protrusion 96 (in particular the rectangular cross-section and the thinness) increases the sensitivity of the seal member 70 to lower fluid pressures (i.e., 10 psi and below). For example, the shape of the outer protrusion 96 allows the outer protrusion 96 to compress more easily, which allows the second seal extension 90 to provide a better seal at low pressures. Comparatively, conventional seal members that are rounded cannot compress as much (especially at low pressures), which decreases the effectiveness of conventional seal members, in particular at low pressures.

Furthermore, the shape and size of the seal member 70 allows the seal member 70 to be optimally positioned within diverter structure 50 and the tub spout body 40 in order to have a particular distance between the end 84 of the first seal extension 80 and the second side 42 of the inner wall 44. This particular distance further allows the seal member 70 to achieve a complete seal. Specifically, the distance between the end 84 of the first seal extension 80 and the second side 42 of the inner wall 44 is 0.025 in ±0.010 in (when the seal member 70 is positioned within the seal housing 62, the diverter structure 50 is in the closed position 54, the back of the diverter gate 60 is pressed flush against a guiding structure (i.e., ribs that guide the diverter gate 60) toward the second end 22 of the tub spout body 40, and no water is flowing through the water pipe 14 into the tub spout body 40). Larger or smaller distances prevent the seal member from creating a complete seal.

Figure 7:
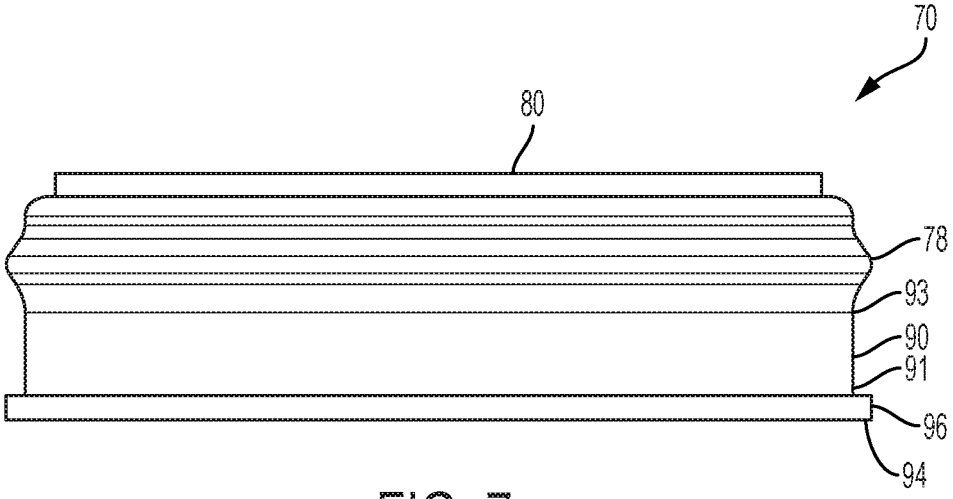
FIG. 7 is a side view of the seal member of FIG. 5.
Figure 8:
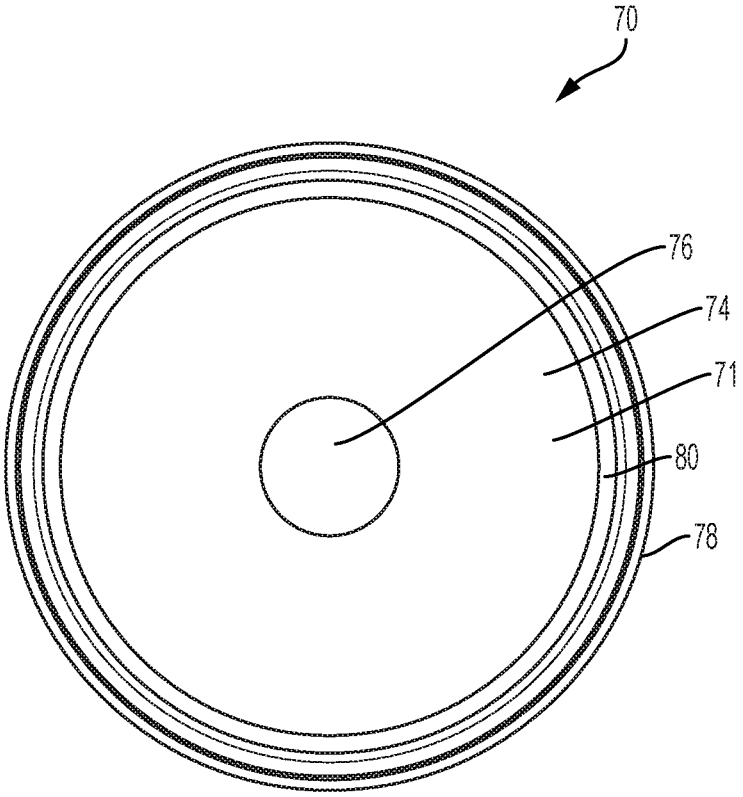
FIG. 8 is a top view of the seal member of FIG. 5.

FIG. 7 shows a side view of the seal member 70, and FIG. 8 shows a top view of the seal member 70.

Exemplary Dimensions

Figure 9:
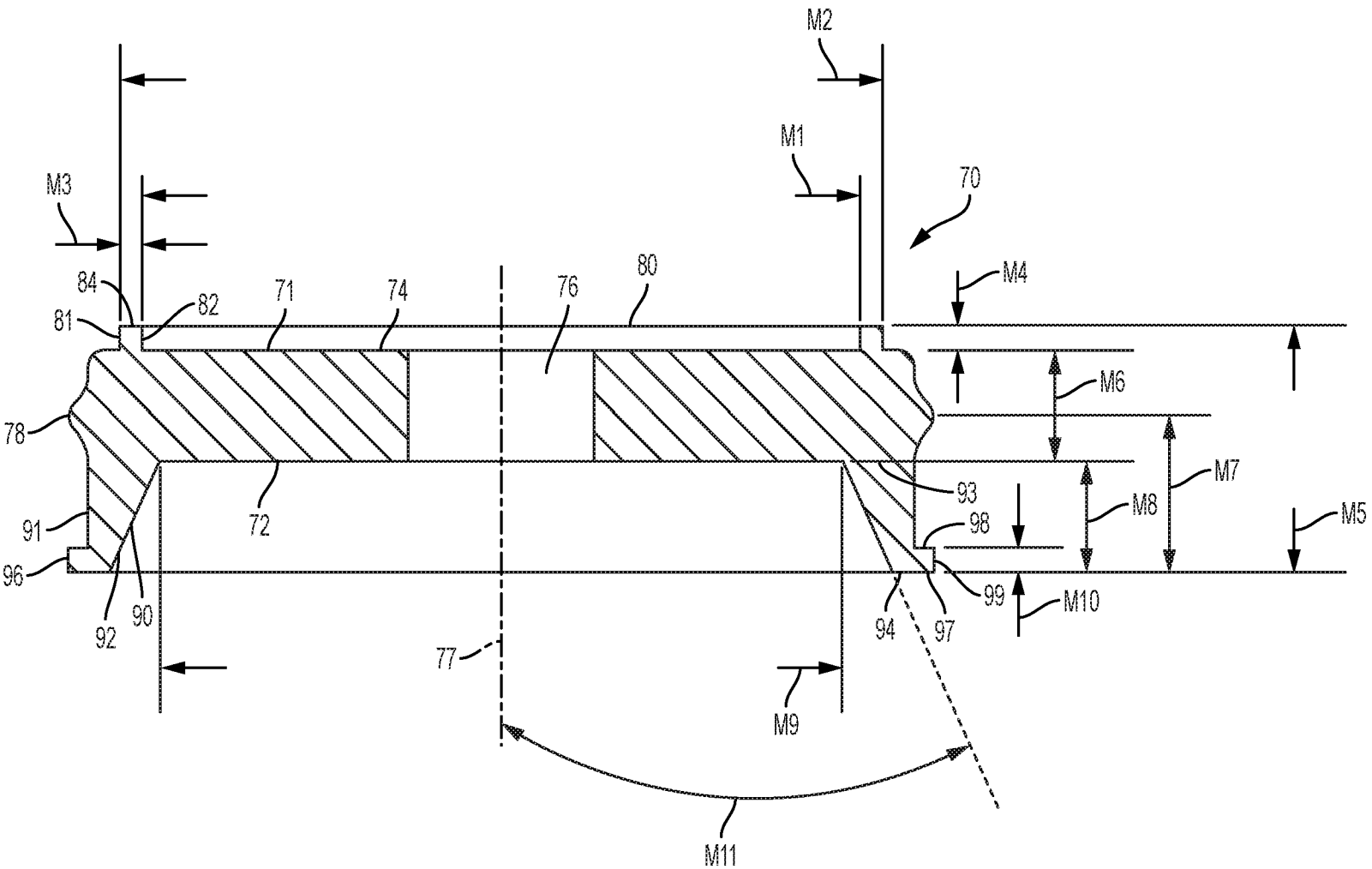
FIG. 9 is another cross-sectional view of the seal member of FIG. 5.

FIG. 9 shows various exemplary dimensions of the seal member 70 according to various embodiments. However, it is understood that each of the dimensions of the seal member 70 may have a tolerance of approximately ±0.005 in or ±0.5°.

As shown, the inner diameter M1 of the first seal extension 80 (i.e., the distance between the second side 82 of the first seal extension 80 along opposite sides of the seal member 70) may be approximately 0.582 to 0.590 inches (in). The outer diameter M2 of the first seal extension 80 (i.e., the distance between the first side 81 of the first seal extension 80 along opposite sides of the seal member 70) may be approximately 0.582 to 0.620 in. Compared to conventional seal members, the first seal extension 80 is positioned relatively further outward from the aperture 76 (i.e., has a greater diameter). The thickness or width M3 of the first seal extension 80 (i.e., the distance between the first side 81 and the second side 82 of the first seal extension 80) may be approximately 0.015 in. The length or height M4 of the first seal extension 80 (i.e., the distance between the end 84 of the first seal extension 80 and the first side 71 of the central body 74) may be approximately 0.020 in.

The total thickness M5 of the seal member 70 (i.e., the distance between the end 84 of the first seal extension 80 and the end 94 of the second seal extension 90) may be approximately 0.190 to 0.200 in. The thickness M6 of the central body 74 (i.e., the distance between the first side 71 and the second side 72 of the central body 74) may be approximately 0.79 in. The distance M7 from the middle or pinnacle of the side protrusion 78 of the central body 74 and the end 94 of the second seal extension 90 may be approximately 0.126 in.

The length M8 of the second seal extension 90 (i.e., the distance between the base 93 and the end 94 of the second seal extension 90) may be approximately 0.090 in. The inner diameter M9 at the base 93 of the second seal extension 90 (i.e., the distance between the base 93 of the second seal extension 90 along opposite sides of the seal member 70) may be approximately 0.514 to 0.592 in (and specifically may be approximately 0.552 to 0.554 in).

The thickness or width M10 of the outer protrusion 96 (i.e., the distance between the first side 97 and the second side 98 of the outer protrusion 96) may be approximately 0.020 in. The angle M11 of the inner side 92 of the second seal extension 90 (i.e., the angle between the inner side 92 and the longitudinal axis of the seal member 70 that extends axially through the aperture 76 and extends substantially parallel to the direction of fluid flow through the aperture 76) may be approximately 25°. The outer side 91 may be substantially parallel to the longitudinal axis of the seal member 70 (and substantially perpendicular to the first and second sides 71, 72 of the central body 74). The inner diameter of the aperture 76 may be approximately 0.150 in.

In order to flex radially outward more easily to be more sensitive to water flow and to create a better seal, in particular under low water pressure, the thickness of the second seal extension 90 (as well as the second seal extension 190, as described further herein) is relatively more thin than any "seal extensions" on conventional diverter seal members. For example, since the second seal extension 90 is tapered, the second seal extension 90 may be approximately 0.039 in thick along the base 93 and 0.016 in thick along the end 94.

The various dimensions and shapes of the seal member 70 allow the seal member 70 to have an approximately 50% increase in sealing force compared to conventional seal members. Furthermore, the various dimensions and shapes of the seal member 70 allow the seal member 70 to have an optimal sealing force differential. The sealing force differential is the seal force of the water pushing the seal member 70 inward into the seal housing 62 (as the water moves toward the first side 71 of the seal member 70 and into the seal member 70) compared to the seal force of the water pushing the seal member 70 outward from the seal housing 62, toward the second side 42 of the inner wall 44 (as the water moves back off of the back wall 64, toward the second side 72 of the seal member 70, and back through the seal member 70, in an opposite direction).

The Seal Member in Use

While the water is completely turned off such that no water flows through the water pipe 14, the diverter structure 50 is in the open position 52 (as shown in FIGS. 1-3 and as described further herein). Once the water is turned on (by, for example, a hand valve (not shown)), the water flows through the water pipe 14, in a direction toward the first side 41 of the inner wall 44 and toward the outlet at the second end 22 of the tub spout body 40. Once the water exits from the water pipe 14 (through the end of the water pipe), the water flows into, along, and through the through-hole 24 of the tub spout body 40. In particular, after exiting the water pipe 14, the water first flows through the aperture 46 in the inner wall 44, from the first side 41 to the second side 42 of the inner wall 44. Because the diverter structure 50 is in the open position 52, the water then flows around and/or through the diverter gate 60 within the through-hole 24 toward the second end 22 of the tub spout body 40. The water subsequently exits the entire tub spout structure 20 through the second end 22 and flows into another area, such as a bathtub.

When the user may decides to divert the water flow to another location or device (such as to a showerhead) instead of to the bathtub, the user lifts the diverter structure 50 upward by pulling up on the handle 56 (e.g., while the water is still flowing through the water pipe 14), which moves the diverter structure 50 from the open position 52 (as shown in FIGS. 1-3) to the closed position 54 (as shown in FIG. 4). Moving the diverter structure 50 to the closed position 54 positions the seal housing 62 and the seal member 70 directly downstream from the aperture 46 in the inner wall 44. As described further below, this position of the seal member 70 allows the seal member 70 to create a seal along the through-hole 24, which stops the water from flowing further along the through-hole 24 and diverts the water to another location or device.

Accordingly, when the diverter structure 50 is in the closed position 54 (and while the water is still turned on), water still flows through the water pipe 14, in a direction toward the first side 41 of the inner wall 44 and toward the outlet at the second end 22 of the tub spout body 40. Once the water exits from the water pipe 14 (through the end of the water pipe), the water flows into the through-hole 24 of the tub spout body 40 and flows through the aperture 46 in the inner wall 44, from the first side 41 to the second side 42 of the inner wall 44. Instead of flowing further along the through-hole 24 (as the water would when the diverter structure 50 is in the open position 52), the water then hits the first side 71 of the central body 74 of the seal member 70 and flows through the aperture 76 of the central body 74, from the first side 71 to the second side 72 of the central body 74.

The water then fills a chamber that is created between the second side 72 of the central body 74, the inner side 92 of the second seal extension 90, and the back wall 64 of the seal housing 62 of the diverter gate 60. As the water hits the back wall 64 of the seal housing 62, the water is forced in a radial, outward direction. The force of the water in the outward direction in this chamber presses against the inner side 92 of the second seal extension 90 in a radially outward manner and thus forces the second seal extension 90 to flex radially outward toward the inner side of the side wall 66 of the seal housing 62 of the diverter gate 60. This movement presses the outer protrusion 96 of the second seal extension 90 against the inner side of the side wall 66, thereby forcing the end 99 of the outer protrusion 96 of the second seal extension 90 to circumferentially seal with the inner side of the side wall 66 and preventing any water from moving between the second seal extension 90 and the inner side of the side wall 66.

Additionally, as the water hits the back wall 64 of the seal housing 62, the water changes or reverses directions and is moved backward in an opposite direction (i.e., in the direction back toward the second side 42 of the inner wall 44 and toward the end of the water pipe 14). This opposite direction is a direction that is away from the outlet at the second end 22 of the tub spout body 40 along the length of the through-hole 24. Accordingly, the water presses against the second side 72 of the central body 74 in this opposite direction, which moves the seal member 70 in a direction back toward the inner wall 44. This movement of the seal member 70 presses the first seal extension 80 against the second side 42 of the inner wall 44, thereby forcing the first seal extension 80 to seal with the second side 42 of the inner wall 44 and preventing any water from moving between the first seal extension 80 and the second side 42 of the inner wall 44.

Accordingly, both the first seal extension 80 and the second seal extension 90 prevent the water from flowing beyond the seal housing 62 when the diverter structure 50 is in the closed position 54 (and when the water is flowing through the water pipe 14).

The pressure of the water flowing through the water pipe 14 and into the inner area of the tub spout body 40 keeps the diverter structure 50 in the closed position 54. However, when the water is turned off and stops flowing (by, for example, a hand valve (not shown)), the absence of water pressure allows the diverter structure 50 to be automatically reset by moving back downward to the open position 52. In particular, since the water no longer presses against the diverter structure 50 and the seal member 70, the diverter structure 50 is free to move relative to the tub spout body 40, thereby allowing gravity to pull the diverter structure 50 (with the seal member 70) downward into the open position 52.

The Second Seal Extension

FIGS. 10-15 show an alternative embodiment of a diverter seal member 170 with a second seal extension 190 that can be used within a spout (e.g., the tub spout structure 20) instead of the diverter seal member 70 shown in FIGS. 5-9. The seal member 170 may have one or more of the various features and configurations of the seal member 70, according to the desired configuration. For example, both the seal members 70 and 170 include the first seal extension 80 and the central body 74.

Figure 10:
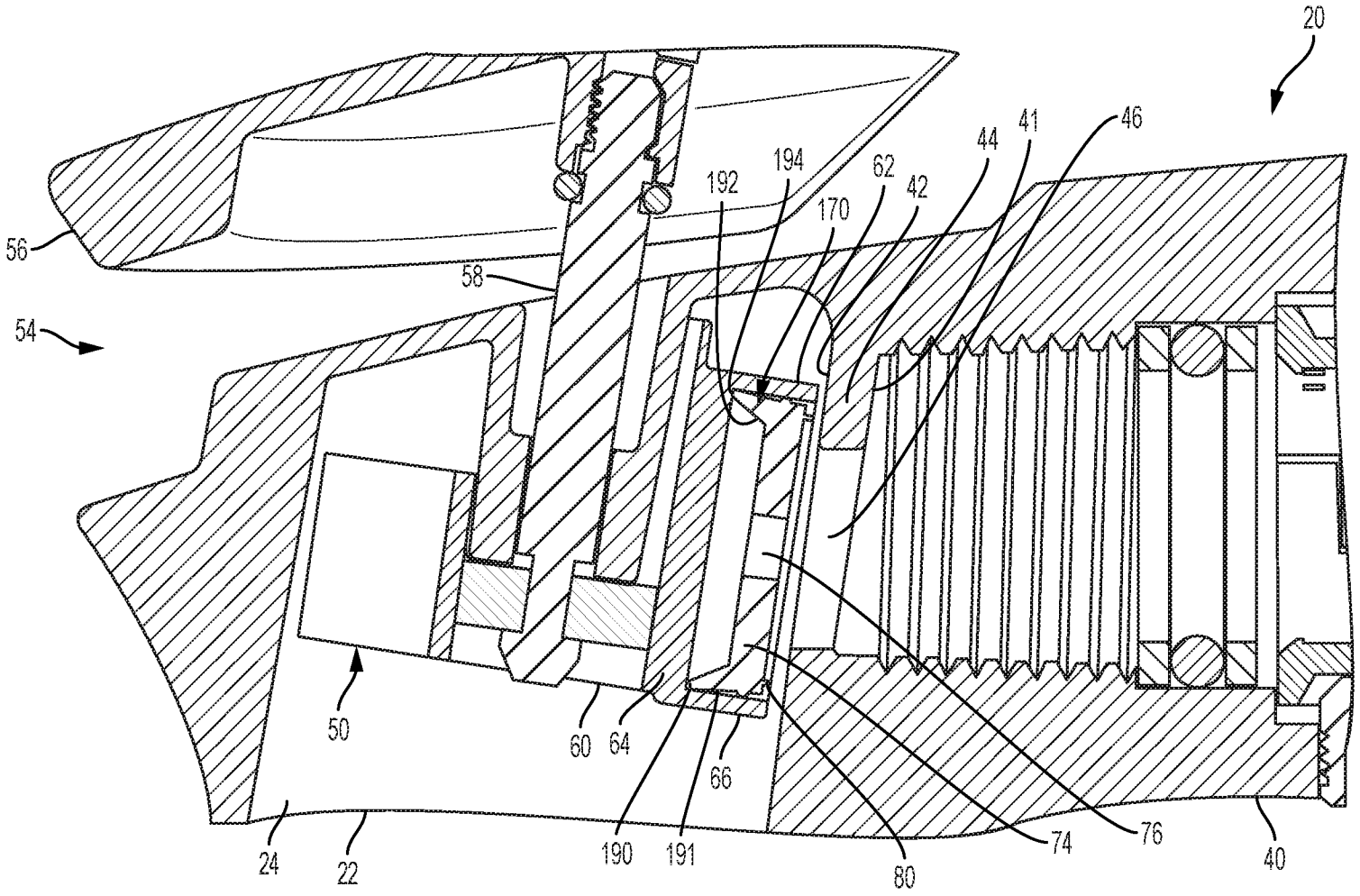
FIG. 10 is an enlarged view of a portion of a tub spout structure according to another embodiment with the diverter structure in a closed position.

However, the seal member 170 includes a second seal extension 190 that is a "cup" seal member, which includes all of the various features and components of the second seal extension 90, except for the outer protrusion 96. Accordingly, as shown in FIG. 10, the outer side 191 of the second seal extension 190 (rather than any outer protrusion) is configured to directly face, abut, and seal to the inner side of the side wall 66 of the seal housing 62 (when the seal member 170 is positioned within the seal housing 62).

The outer side 191 and the inner side 192 of the second seal extension 190 may have the angles shown in FIGS. 10-15 or the angles shown with the outer side 91 and the inner side 92, respectively, of the second seal extension 90 in FIGS. 5-9. As shown in FIGS. 10-15, the outer side 191 and the inner side 192 may both extend at an oblique angle relative to and from the second side 72 of the central body 74. Accordingly, the relative angles of the outer side 191 and the inner side 192 (which creates a taper along the length of the second seal extension 190) allows the second seal extension 190 to bend and flex the correct amount in order to create a complete seal. Accordingly, the optimal ratio of the angle M12 to the angle M13 (as described further herein and shown in FIG. 15) of the second seal extension 190 in order to achieve a complete seal is approximately 1.1±0.05°.

Figure 11:
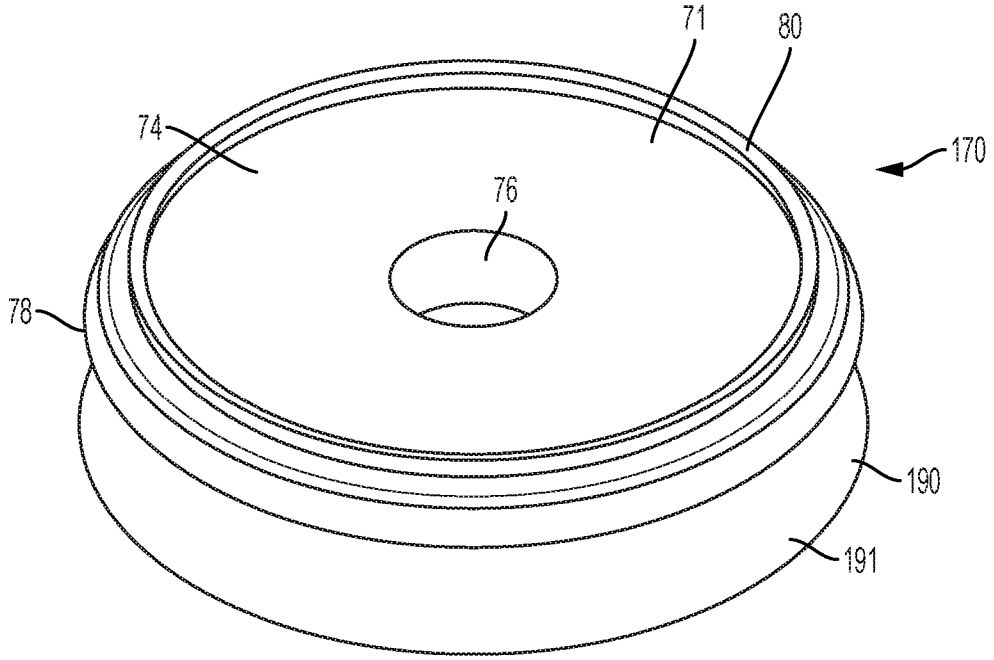
FIG. 11 is a perspective view of a seal member according to another embodiment.
Figure 12:
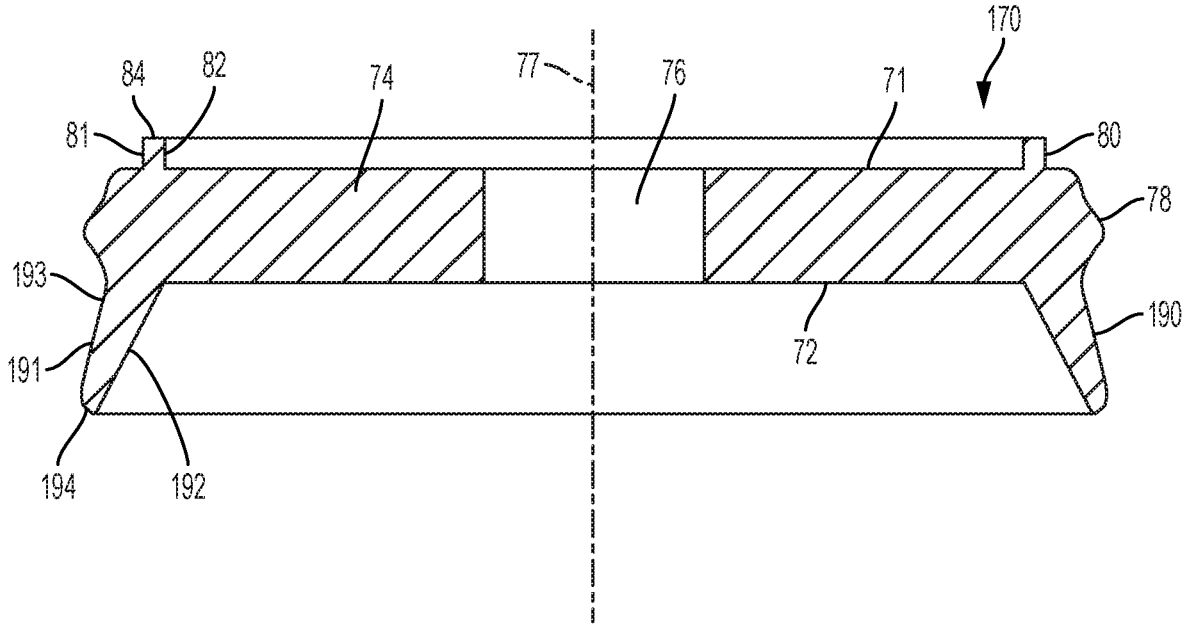
FIG. 12 is a cross-sectional view of the seal member of FIG. 11.

FIG. 11 shows a perspective view of the seal member 170. As shown in FIG. 12, the second seal extension 190 includes a first or outer surface or side 191, a second or inner surface or side 192, a base 193, and a tip or end 194 (which may be similar to and include the various features and components of the outer side 91, the inner side 92, the base 93, and the end 94, respectively, unless otherwise noted in the description herein). However, the second seal extension 190 does not include any protrusions (such as the outer protrusion 96) that extend outwardly from the outer side 191 between the base 193 and the end 194 of the second seal extension 190. Instead, the outer side 191 is substantially straight or extends substantially linearly from the base 193 to the end 194 of the second seal extension 190 without any outer protrusions, flanges, or other protruding or extending features. However, the end 194 may curve or taper inwardly from the outer side 191 to the inner side 192 with a radius of approximately 0.0156 in, for example only. The outer side 191 and the inner side 192 of the second seal extension 190 converge together at the end 194.

Figure 13:
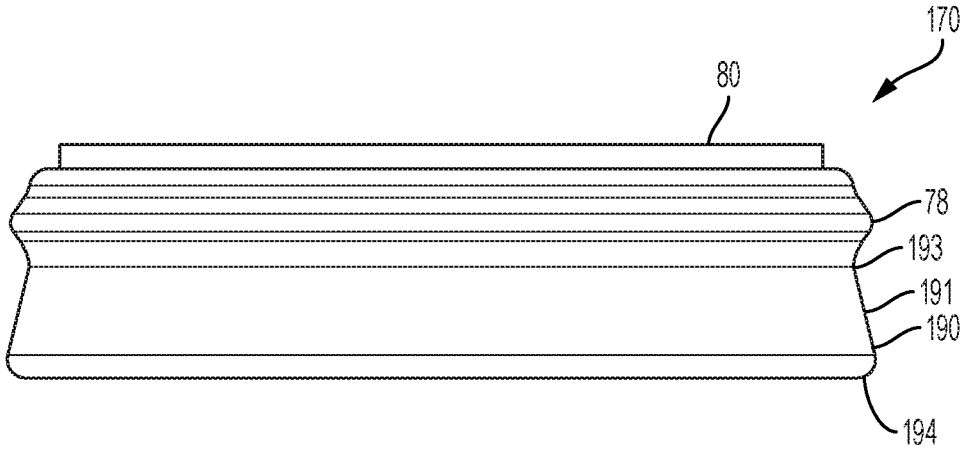
FIG. 13 is a side view of the seal member of FIG. 11.
Figure 14:
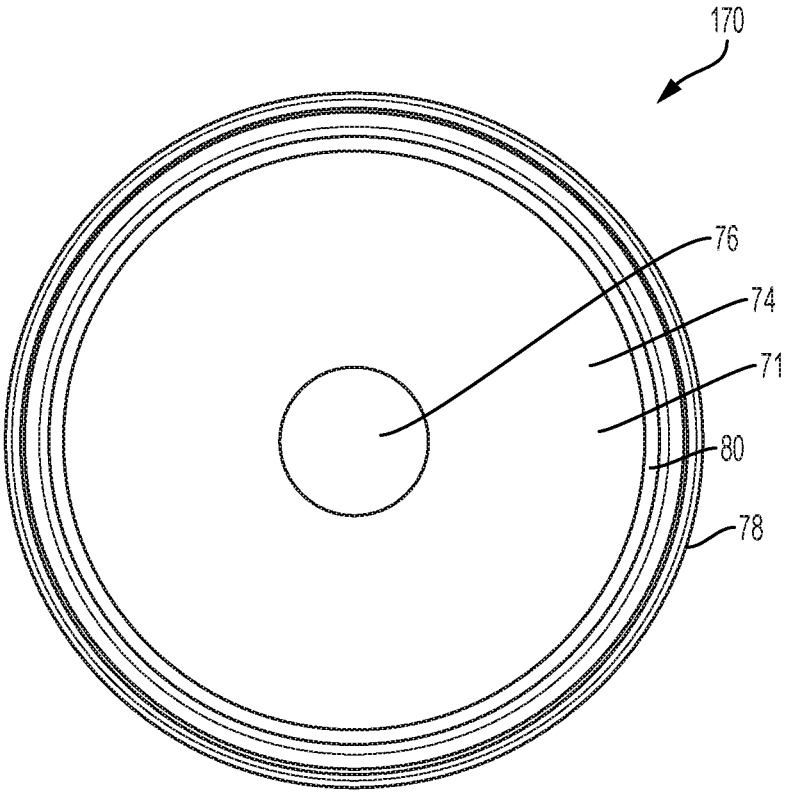
FIG. 14 is a top view of the seal member of FIG. 11.

FIG. 13 shows a side view of the seal member 170, and FIG. 14 shows a top view of the seal member 170.

Figure 15:
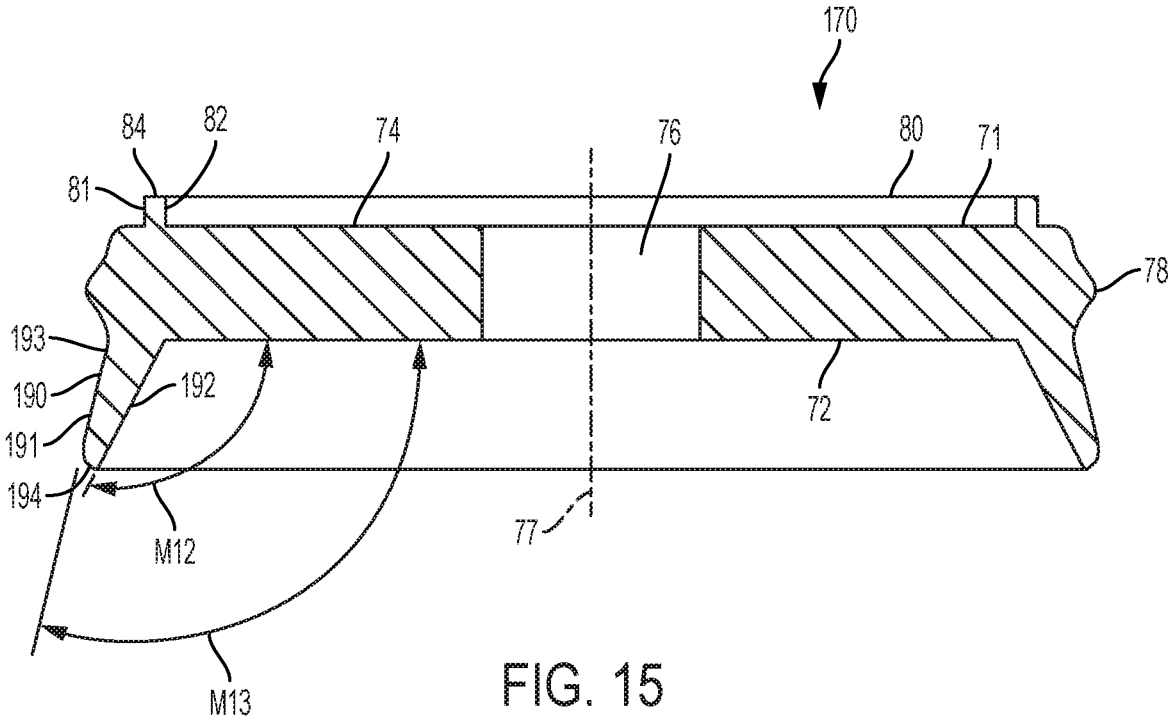
FIG. 15 is another cross-sectional view of the seal member of FIG. 11.

FIG. 15 shows various exemplary dimensions of the seal member 170. However, it is understood that each of the dimensions of the seal member 170 may have a tolerance of approximately ±5°. The seal member 170 may share similar dimensions to the seal member 70, according to the desired configuration. However, the second seal extension 190 may optionally be thinner than the second seal extension 90 since the second seal extension 90 includes and can rely on the outer protrusion 96, whereas the second seal extension 190 does not include any outer protrusion and therefore may be relatively more thin in order to be more flexible. Accordingly, the entire second seal extension 90 does not have to move or flex as much as the second seal extension 190 in order for the outer protrusion 96 of the second seal extension 90 or the outer side 191 of the second seal extension 190, respectively, to seal to the inner surface of the side wall 66.

Furthermore, compared to conventional seal members, the second seal extension 190 is positioned relatively further outward (i.e., has a greater inner diameter along the base 193), which increases the surface area along the downstream side of the seal member 170. This increased surface area allows the water to more easily move the seal member 170 back toward the second side 42 of the inner wall 44 during use, thereby creating a better seal between the first seal extension 80 and the second side 42 of the inner wall 44.

The angle M12 of the inner side 192 of the second seal extension 190 (i.e., the angle between the inner side 192 and the plane defined by (or parallel to) the second side 72 of the central body 74) may be approximately 117.554°. The angle M13 of the outer side 191 of the second seal extension 190 (i.e., the angle between the outer side 191 and the plane defined by (or parallel to) the second side 72 of the central body 74) may be approximately 103.684°. Said another way, the angle between the inner side 192 of the second seal extension 190 and the longitudinal axis of the seal member 170 (that extends axially through the aperture 76 and extends substantially parallel to the direction of fluid flow through the aperture 76) may be approximately 28°. The angle between the outer side 191 of the second seal extension 190 and the longitudinal axis of the seal member 170 may be approximately 14°. Accordingly, the outer side 191 and the inner side 192 of the second seal extension 190 may extend from the second side 72 of the central body 74 at different angles.

Triangular Seal Members

Figure 16:
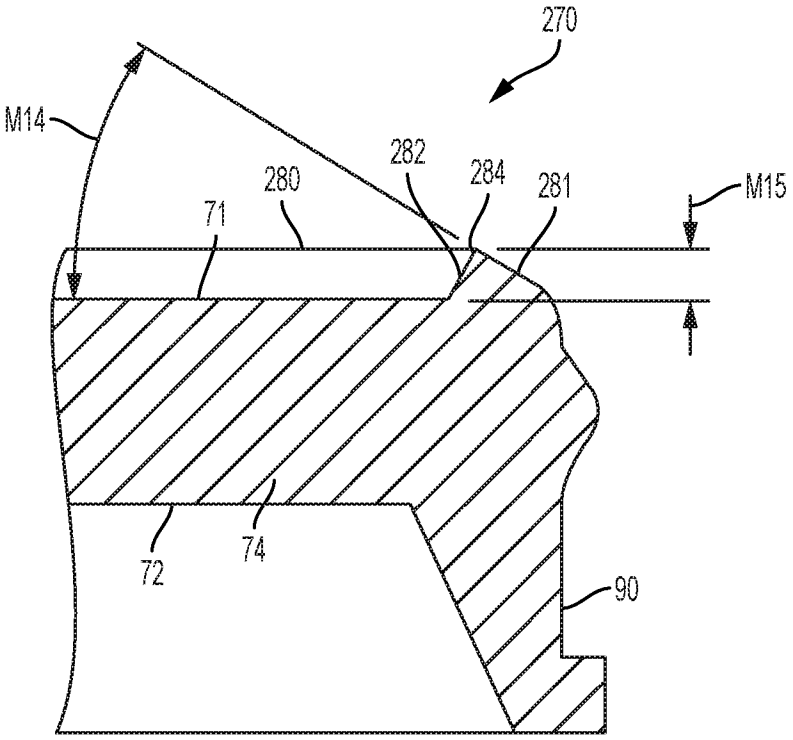
FIG. 16 is a cross-sectional view of a portion of a seal member according to another embodiment.

FIG. 16 shows an alternative embodiment of a diverter seal member 270 with a first seal extension 280 that can be used within a spout (e.g., the tub spout structure 20) instead of the diverter seal members 70, 170, or 370. The seal member 270 may have one or more of the various features and configurations of the seal member 70, 170, or 370, according to the desired configuration. For example, the seal member 270 includes the central body 74 and the second seal extension 90 (although the seal member 270 could alternatively include the second seal extension 190).

However, the seal member 270 includes a first seal extension 280, which includes all of the various features and components of the first seal extension 80, except for the rectangular cross-sectional shape of the first seal extension 80. Instead, as shown in FIG. 16, the first seal extension 280 has a substantially triangular cross-section.

As shown in FIG. 16, the first seal extension 280 has a first side 281, a second side 282, and a tip or end 284 (which may be similar to and include the various features and components of the first side 81, the second side 82, and the end 84, respectively, unless otherwise noted in the description herein). However, the first side 281 and the second side 282 extend at oblique angles towards each other from the first side 71 of the central body 74. The first side 281 and the second side 282 converge together at the end 284. The end 284 forms an edge of the first seal extension 280 that is substantially parallel to the first side 71 of the central body 74. Accordingly, the first seal extension 280 has a substantially triangular cross-section.

The first side 281 and the second side 282 may be approximately the same length as each other (and optionally creating an equilateral triangle) or different lengths (creating a scalene triangle). For example, as shown in FIG. 16, the first side 281 is longer than the second side 282.

FIG. 16 shows various exemplary dimensions of the seal member 270. However, it is understood that each of the dimensions of the seal member 270 may have a tolerance of approximately ±0.005 in or ±5°. The seal member 270 may share similar dimensions to the seal members 70, 170, or 370, according to the desired configuration. The angle M14 between the first side 281 of the first seal extension 280 and the first side 71 of the central body 74 may be approximately 31°. The length or height M15 of the first seal extension 280 (i.e., the distance between the end 284 of the first seal extension 280 and the first side 71 of the central body 74) may be approximately 0.020 in.

Figure 17:
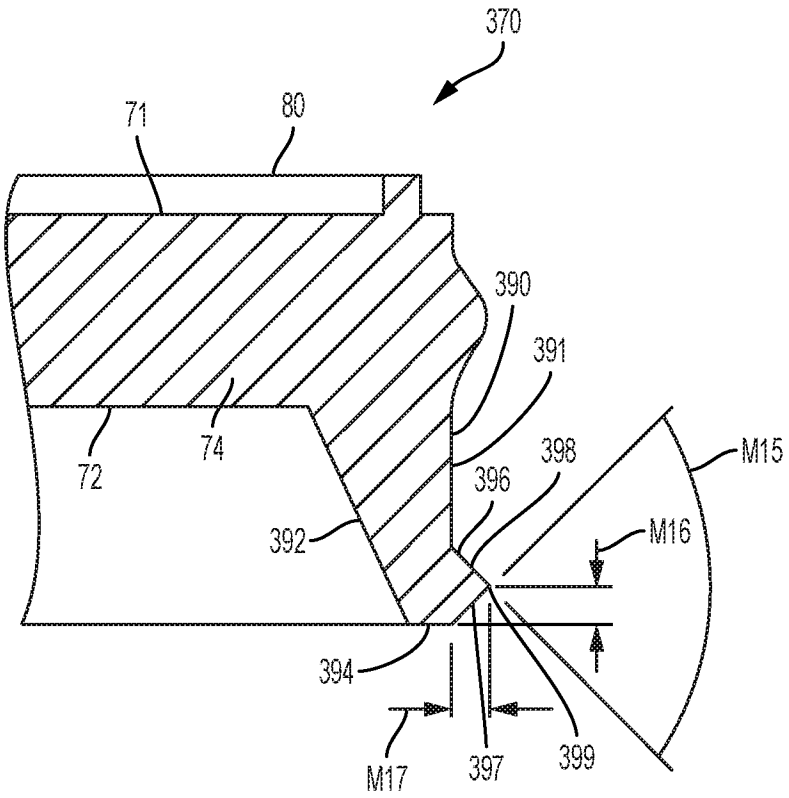
FIG. 17 is a cross-sectional view of a portion of a seal member according to another embodiment.

FIG. 17 shows an alternative embodiment of a diverter seal member 370 with a second seal extension 390 that can be used within a spout (e.g., the tub spout structure 20) instead of the diverter seal members 70, 170, or 270. The seal member 370 may have one or more of the various features and configurations of the seal member 70, 170, or 270, according to the desired configuration. For example, the seal member 270 includes the central body 74 and the first seal extension 80 (although the seal member 270 could alternatively include the first seal extension 280).

However, the seal member 370 includes a second seal extension 380, which includes all of the various features and components of the second seal extension 90, except for the rectangular cross-sectional shape of the outer protrusion 96. Instead, as shown in FIG. 17, the second seal extension 390 has an outer protrusion 396 with a substantially triangular cross-section.

As shown in FIG. 17, the second seal extension 390 has an outer side 391, an inner side 392, a base, a tip or end 394, and an outer protrusion 396 (which may be similar to and include the various features and components of the outer side 91, the inner side 92, the base 93, the end 94, and the outer protrusion 96, respectively, unless otherwise noted in the description herein). The outer protrusion 396 includes a first side 397, a second side 398, and a tip or end 399 (which may be similar to and include the various features and components of the first side 97, the second side 98, and the end 99, respectively, unless otherwise noted in the description herein). However, the first side 397 and the second side 398 of the outer protrusion 396 extend at oblique angles towards each other from the outer side 391 of the second seal extension 390. The first side 397 and the second side 398 converge together at the end 399. The end 399 forms an edge of the outer protrusion 396 that is substantially parallel to the outer side 391 of the second seal extension 390. Accordingly, the outer protrusion 396 has a substantially triangular cross-section.

The first side 397 and the second side 398 may be approximately the same length as each other (and optionally creating an equilateral triangle) or different lengths (creating a scalene triangle). Furthermore, the first side 397 extends directly into the end 394 such that there is no vertical space between the outer protrusion 96 and the end 394.

FIG. 17 shows various exemplary dimensions of the seal member 370. However, it is understood that each of the dimensions of the seal member 370 may have a tolerance of approximately ±0.005 in or ±5°. The seal member 370 may share similar dimensions to the seal members 70, 170, or 270, according to the desired configuration. The angle M15 between the first side 397 and the second side 398 may be approximately 90°. The distance M16 between the end 399 of the outer protrusion 396 and the end 394 of the second seal extension 390 may be approximately 0.016 in. The length or height M17 of the outer protrusion 396 (i.e., the distance between the end 399 of the outer protrusion 396 and the outer side 391 of the second seal extension 390) may be approximately 0.016 in.

The seal members 70 and 170 are both configured to prevent any leaks from the tub spout structure 20 when the diverter structure 50 is in the closed position 54, even when the fluid pressure through the water pipe 14 is below 10 psi. In particular, the seal member 70 can prevent leaks at pressures, for example, at or below 8-9 psi, and the seal member 170 can prevent leaks at pressures, for example, at or below 3 psi. The seal members 270 and 370 are also configured to prevent leaks.

The seal members 70, 170, 270, and 370 may be constructed out of a variety of different materials, such as an elastomer or rubber. According to one embodiment, the seal members 70, 170, 270, and 370 may be constructed out of silicone with a durometer of 65+/−5 Shore A. In particular, the seal members 70, 170, 270, and 370 may be constructed out of a liquid silicone (LSR) in order to provide a softer, longer-lasting material that does not harden or collect debris. Comparatively, conventional seal members are constructed out of nitrile rubber (NBR) or ethylene propylene diene monomer rubber (EPDM), which are tougher and inexpensive materials.

It is understood that any of the components or features of the diverter seal members 70, 170, 270, and 370 can be used together or separately in any number of different combinations.

As utilized herein, the term "substantially" refers to ±0.005 in or 0.5°. As further utilized herein, the terms "approximately," "about," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the tub spout seal as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to exemplary embodiments. Other substitutions, modifications, changes and omissions may also be made in the design, operating conditions and arrangement of the various exemplary embodiments without departing from the scope of the present disclosure.

What is claimed is:

1. A diverter seal member for a diverter structure of a tub spout structure, the diverter seal member comprising:

a central body including a first side, a second side, and an aperture extending completely through the central body between the first side and the second side of the central body;

a first seal extension extending from the first side of the central body and around a central axis that extends axially through a center of the aperture, wherein the first seal extension includes a first extension side, a second extension side, and an extension end, wherein the extension end of the first seal extension extends substantially perpendicularly to the first extension side and the second extension side of the first seal extension; and a second seal extension extending from the second side of the central body around the central axis of the aperture.

2. The diverter seal member of claim 1, wherein the first extension side and the second extension side of the first seal extension extend substantially perpendicularly from the first side of the central body.

3. The diverter seal member of claim 1, wherein the second seal extension has a tapered cross-section.

4. The diverter seal member of claim 1, wherein the second seal extension includes an outer side, an inner side, a base, and an end, wherein the inner side is positioned radially inward from the outer side, wherein the base is positioned along the second side of the central body, wherein the end is positioned opposite to the base of the second seal extension.

5. The diverter seal member of claim 4, wherein at least one of the outer side and the inner side of the second seal extension extends at an oblique angle relative to and from the second side of the central body.

6. The diverter seal member of claim 4, wherein the second seal extension includes an outer protrusion that protrudes radially outwardly from the outer side between the base and the end of the second seal extension.

7. The diverter seal member of claim 6, wherein the outer protrusion has a first protrusion side, a second protrusion side, and a protrusion end, wherein the protrusion end of the outer protrusion extends substantially perpendicularly to the first protrusion side and the second protrusion side of the outer protrusion.

8. The diverter seal member of claim 7, wherein the first protrusion side and the second protrusion side of the outer protrusion extend substantially perpendicularly relative to the outer side of the second seal extension.

9. The diverter seal member of claim 4, wherein the outer side extends substantially linearly from the base to the end of the second seal extension.

10. The diverter seal member of claim 4, wherein the second seal extension does not include any protrusions along the outer side between the base and the end of the second seal extension.

11. A diverter structure for a tub spout structure, the diverter structure comprising:

a diverter gate including a seal housing, wherein the seal housing includes a back wall and a circumferential side wall that extends substantially perpendicularly to the back wall; and a diverter seal member configured to be positioned within a cup defined by the back wall and the side wall of the seal housing of the diverter gate, the diverter seal member comprising:

a central body including a first side, a second side, and an aperture extending completely through the central body between the first side and the second side of the central body, a first seal extension extending from the first side of the central body and around a central axis that extends axially through a center of the aperture, wherein the first seal extension includes a first extension side, a second extension side, and an extension end, wherein the extension end of the first seal extension extends substantially perpendicularly to the first extension side and the second extension side of the first seal extension, and a second seal extension extending from the second side of the central body around the central axis of the aperture.

12. The diverter structure of claim 11, wherein the second seal extension includes an outer side, an inner side, a base, and an end, wherein the inner side is positioned radially inward from the outer side, wherein the base is positioned along the second side of the central body, wherein the end is positioned opposite to the base of the second seal extension, wherein the second seal extension includes an outer protrusion that protrudes radially outwardly from the outer side between the base and the end of the second seal extension.

13. The diverter structure of claim 12, wherein the outer protrusion has a first protrusion side, a second protrusion side, and a protrusion end, wherein the protrusion end of the outer protrusion extends substantially perpendicularly to the first protrusion side and the second protrusion side of the outer protrusion, wherein the first protrusion side and the second protrusion side of the outer protrusion extend substantially perpendicularly relative to the outer side of the second seal extension.

14. The diverter structure of claim 12, wherein the protrusion end of the outer protrusion of the second seal extension is configured to directly abut an inner side of the circumferential side wall of the seal housing.

15. The diverter structure of claim 11, wherein the outer side extends substantially linearly from the base to the end of the second seal extension, wherein the second seal extension does not include any protrusions along the outer side between the base and the end of the second seal extension.

16. The diverter structure of claim 15, wherein the outer side of the second seal extension is configured to directly abut an inner side of the circumferential side wall of the seal housing.

17. A tub spout structure comprising:

a tub spout body having an inlet configured to receive water, an outlet, and a through-hole fluidly connecting the inlet and the outlet;

a diverter structure comprising a diverter gate, wherein the diverter gate includes a seal housing that includes a back wall and a circumferential side wall that extends substantially perpendicularly to the back wall; and a diverter seal member configured to be positioned within a cup defined by the back wall and the side wall of the seal housing of the diverter gate, the diverter seal member comprising:

a central body including a first side, a second side, and an aperture extending completely through the central body between the first side and the second side of the central body, a first seal extension extending from the first side of the central body and around a central axis that extends axially through a center of the aperture, wherein the first seal extension includes a first extension side, a second extension side, and an extension end, wherein the extension end of the first seal extension extends substantially perpendicularly to the first extension side and the second extension side of the first seal extension, and a second seal extension extending from the second side of the central body around the central axis of the aperture;

wherein the seal housing is moveable relative to the tub spout body such that the seal housing and the diverter seal member block a flow of the water to the outlet in a closed position.

18. The tub spout structure of claim 17, wherein the first extension side and the second extension side of the first seal extension extend substantially perpendicularly from the first side of the central body.

19. The tub spout structure of claim 17, wherein in the closed position, the entire extension end is configured to contact an inner wall of the tub spout body.

20. The tub spout structure of claim 17, wherein the second seal extension is configured to flex radially outwardly when the diverter structure is in the closed position and water is flowing toward the seal member from the inlet of the tub spout body.

* * * * *